United States Patent [19]

Taflove et al.

[11] Patent Number: 4,662,438

[45] Date of Patent: May 5, 1987

[54] METHOD AND APPARATUS FOR ENHANCING LIQUID HYDROCARBON PRODUCTION FROM A SINGLE BOREHOLE IN A SLOWLY PRODUCING FORMATION BY NON-UNIFORM HEATING THROUGH OPTIMIZED ELECTRODE ARRAYS SURROUNDING THE BOREHOLE

[75] Inventors: Allen Taflove, Wilmette; Guggilam C. Sresty, Burbank; Korada Umashankar, Wheaton, all of Ill.

[73] Assignee: Uentech Corporation, Tulsa, Okla.

[21] Appl. No.: 757,018

[22] Filed: Jul. 19, 1985

[51] Int. Cl.[4] ..... E21B 43/24; E21B 43/30

[52] U.S. Cl. ..... 166/245; 166/60; 166/65.1; 166/248; 166/250

[58] Field of Search ..... 166/245, 248, 60, 65.1, 166/250

[56] References Cited

U.S. PATENT DOCUMENTS

| | | | |
|---|---|---|---|
| Re. 307,738 | 9/1981 | Bridges et al. | 166/248 |
| 1,784,214 | 12/1930 | Workman . | |
| 2,118,669 | 5/1938 | Grebe . | |
| 3,137,347 | 6/1964 | Parker . | |
| 3,141,099 | 7/1964 | Brandon | 310/4 |
| 3,149,672 | 9/1964 | Orkiszewski et al. | 166/60 X |
| 3,189,088 | 6/1965 | Cronberger . | |
| 3,211,220 | 10/1965 | Sarapuu | 166/39 |
| 3,417,823 | 12/1968 | Faris . | |
| 3,507,330 | 4/1970 | Gill | 166/248 |
| 3,530,936 | 9/1970 | Gunderson | 166/248 |
| 3,547,193 | 12/1970 | Gill | 166/248 |
| 3,620,300 | 11/1971 | Crowson | 166/248 |
| 3,642,066 | 2/1972 | Gill | 166/248 |
| 3,718,186 | 2/1973 | Brandon | 166/248 |
| 3,766,980 | 10/1973 | Kern | 166/248 |
| 3,848,671 | 11/1974 | Kern | 166/248 |
| 3,862,662 | 1/1975 | Kern | 166/248 |
| 3,874,450 | 4/1975 | Kern | 166/248 |
| 3,878,312 | 4/1975 | Bergh et al. | 174/9 |
| 4,010,799 | 3/1977 | Kern et al. | 166/248 |
| 4,084,639 | 4/1978 | Todd | 166/248 |
| 4,124,483 | 11/1978 | Christenson | 204/299 |
| 4,140,179 | 2/1979 | Kasevich et al. | 166/248 |
| 4,199,025 | 4/1980 | Carpenter | 166/60 X |
| 4,382,469 | 5/1983 | Bell et al. | 166/248 |
| 4,456,065 | 6/1984 | Helm et al. | 166/248 |
| 4,463,805 | 8/1984 | Bingham | 166/60 X |
| 4,489,782 | 12/1984 | Perkins | 166/248 |
| 4,495,990 | 1/1985 | Titus et al. | 166/65.1 |
| 4,498,535 | 2/1985 | Bridges | 166/248 |
| 4,524,827 | 6/1981 | Bridges et al. | 166/248 |
| 4,550,779 | 11/1985 | Zakiewicz | 166/248 |

*Primary Examiner*—George A. Suchfield
*Attorney, Agent, or Firm*—Vaden, Eickenroht, Thompson & Boulware

[57] ABSTRACT

Method and apparatus for enhancing liquid hydrocarbon production through a single traditional producing borehole recognizing traditional producing well spacing from a slowly producing formation by use of non-uniform heating through interrelated electrode arrays surrounding the borehole. Heating the formation around the borehole through an interrelated electrode array designed for the formations geometry and geophysics favorably redistributes the pressure gradient throughout the formation for a substantial distance beyond the borehole permitting net energy effective production. One optimum electrode array may consist of ring electrodes or electrode segments so disposed as to electrically approximate a ring. Electrically conductive well bore casing in the formation may be used as an electrode. A return electrode of low impedance disposed close to the surface of the earth may be utilized.

39 Claims, 8 Drawing Figures

FIG.1
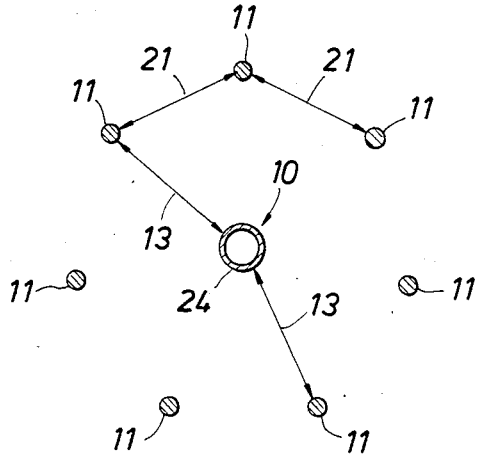
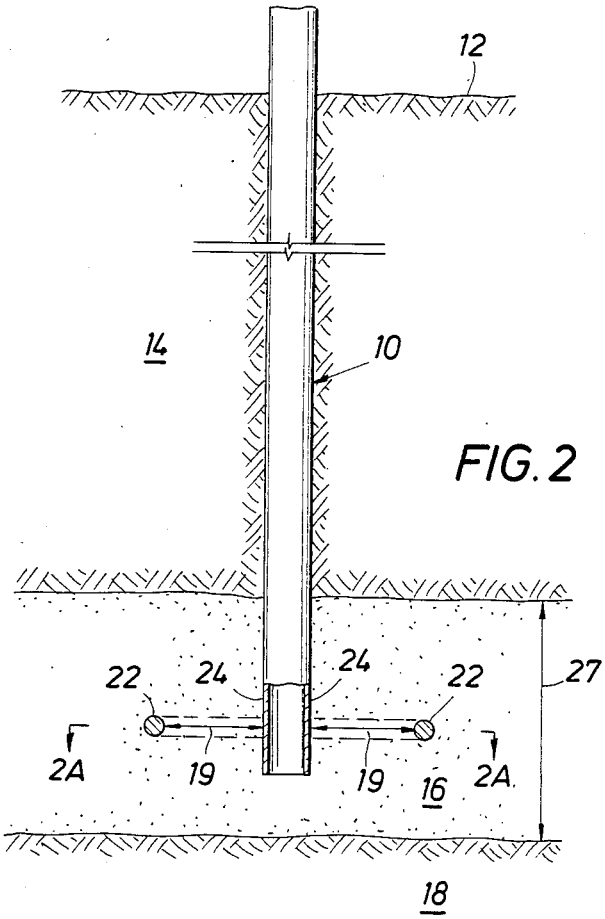
FIG. 2
FIG.1A
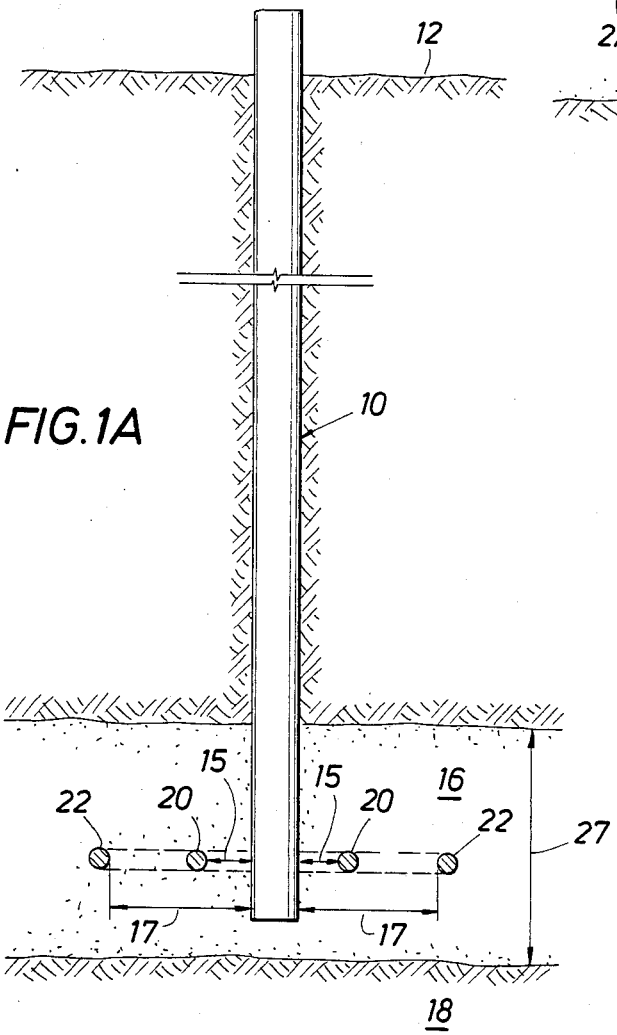
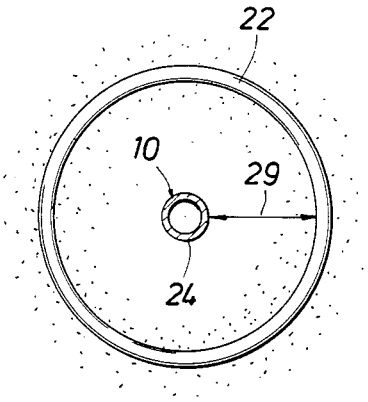
FIG. 2A

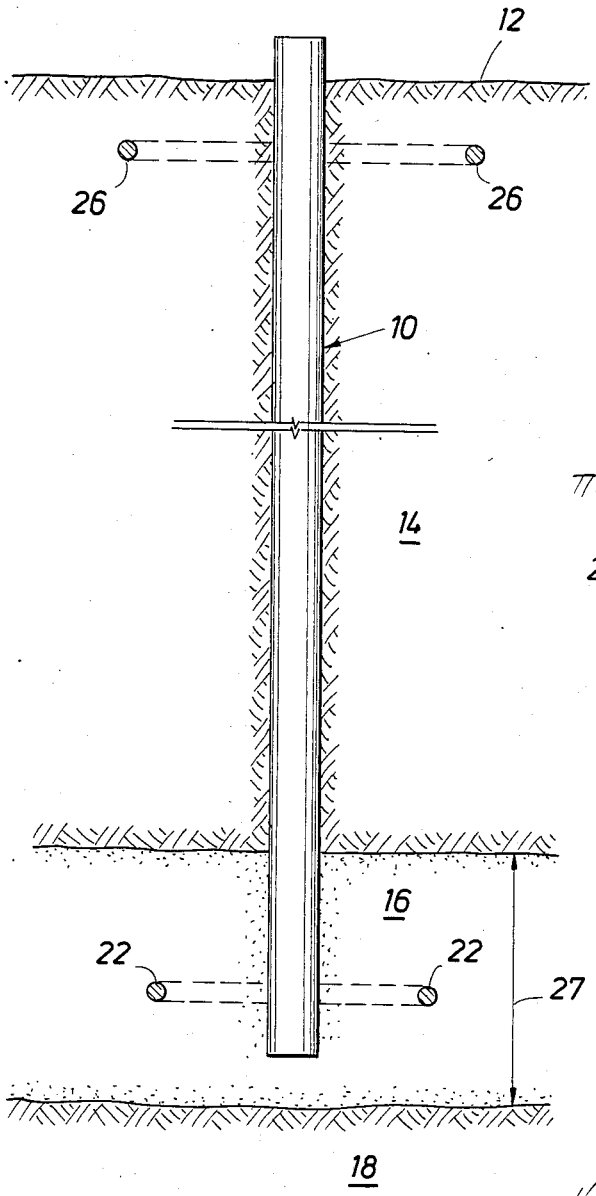
FIG. 5
FIG. 6
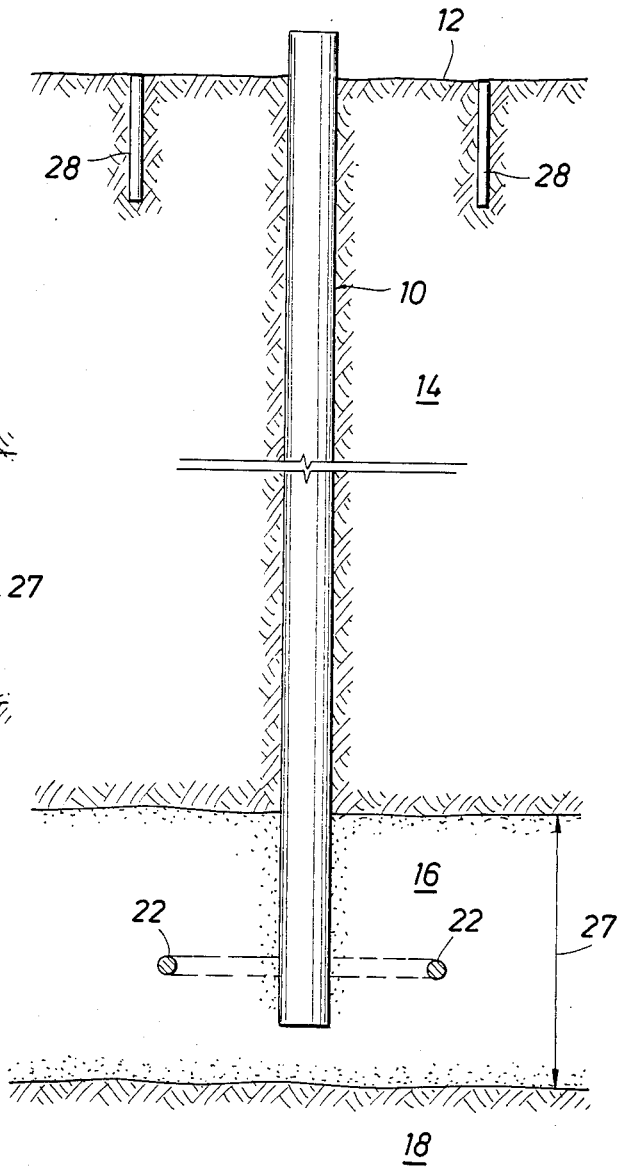

METHOD AND APPARATUS FOR ENHANCING LIQUID HYDROCARBON PRODUCTION FROM A SINGLE BOREHOLE IN A SLOWLY PRODUCING FORMATION BY NON-UNIFORM HEATING THROUGH OPTIMIZED ELECTRODE ARRAYS SURROUNDING THE BOREHOLE

BACKGROUND OF THE INVENTION

1. Field of the Invention

This invention relates to electrically enchanced production of liquid hydrocarbons from slowly producing subsurface formations through a borehole extending from the surface of the earth to the formation. More specifically, this invention relates to the optimized disposition of electrodes surrounding a borehole for energy efficient heating of the formation to maximize production of the liquid hydrocarbons from portions of the formation substantially beyond the electrodes while minimizing cost.

2. Description of the Prior Art

In many deposits, especially in medium and heavy oil deposits, tar sand deposits, and light oil deposits containing paraffins, the viscosity of the oil impedes flow, especially in the immediate vicinity of the borehole through which the oil is being produced. As all of the oil must flow into the borehole, the mobility of the fluid in the immediate vicinity of the borehole dominates the production rate. Any impediment to fluid flow at the borehole is particularly unwelcome.

It is known to heat the oil formations, particularly in the vicinity of the borehole, to lower the viscosity of the liquids in the deposit and hence provide greater mobility and more profitable production. Steam injection has been used to heat a deposit to reduce the viscosity of the oil in the vicinity of the borehole. To some extent steam can be used as a heat transport medium and steam can be used on some deposits economically. However, if steam is injected from the surface it loses a large amount of heat as it progresses down the hole, wastefully heating formations above the formation of interest. This has given impetus to the development of downhole steam generators, which, in turn, have problems of their own. Further, this use of steam stimulation is uneconomic in many deposits.

A number of electric heating methods have been considered for formations in which water is present, as it is in most formations, in the intersticial spaces in a low-loss medium, such as quartz sandstone. It is known to provide uniform heating of such a formation by interwell energization, as shown, for example, in Bridges and Taflove, U.S. Reissue Pat. No. Re. 30,738. Such methods require relatively extensive boreholes and comprehensive development of the field, which is not always warranted. Others, for instance Kern, U.S. Pat. No. 3,848,671, have proposed use of multiple electrodes to heat almost all of the deposit non-uniformly as a preconditioning step prior to a fluid replacement process. Some methods are directed to deposits which do not flow without stimulation. Specific target formations for this approach are oil shale and tar sand deposits which lack native drive. Here, heating must be excessive because of the high temperature needed to convert the solid-like hydrocarbonaceous material to free-flowing fluids. Single well heating is shown in Sarapuu, U.S. Pat. No. 3,211,220, which shows the application of electric power between an electrode in a formation and a distributed electrode at or near the earth's surface.

It has been proposed that single well stimulation is more effective if heat can be applied some distance into the formations from a borehole. To this end it has been suggested to extend the electrodes themselves from the borehole laterally out into the formation. See, for example, Kern U.S. Pat. No. 3,874,450; Todd U.S. Pat. No. 4,084,639; Gill U.S. Pat. No. 3,547,193; Crowson U.S. Pat. No. 3,620,300; and Orkiszewski, et al. U.S. Pat. No. 3,149,672. In Crowson U.S. Pat. No. 3,620,300 there is shown a method and system wherein not only the electrodes but also insulating barriers are extended out into the formations.

A method of borehole enlargement using lateral drain holes which can also be practiced in combination with electric heating is described by Perkins (U.S. Pat. No. 4,489,782). Perkins' method involves completing a production well with lateral drain holes extending from the borehole in the formation, which drain holes produce in conjunction with electric stimulation arising from using the drain holes as electrodes. The use of lateral drain hole schemes can raise additional questions associated with regulatory restrictions upon the number of producing wells per acre. This invention operates under the constraint of enhancing production of liquid hydrocarbons through traditional boreholes with traditional production borehole spacing.

Bridges, et al. have described single well stimulation methods using either a single applicator or a set of two electrodes disposed inside the borehole (U.S. Pat. No. 4,524,827). The methods described by Bridges, et al. produce highly concentrated heating patterns around the borehole.

Gill, U.S. Pat. No. 3,642,066, as an augmentation to his electro-osmosis treatment, teaches also heating a formation through passage of current from a borehole to an electrode well. Gill does not teach surrounding a borehole with an integrated array of electrodes or ring-like electrodes. Gill does not teach passing current between the electrodes to the exclusion of the borehole surrounded. Gill does not teach the necessity of optimizing the dimensions and configurations of the array together with the power expended in relation to formation geometry and geophysics to achieve a synergistic effect.

It is a feature of the present invention to enhance the recovery of liquid hydrocarbons from a slowly producing subsurface formation through a borehole extending from the surface of the earth into the formation in an improved manner wherein only a limited portion of the formation is heated by the application of optimum electric power between an optimally configured interrelated electrode array disposed in the formation around the borehole, or between such electrode array and a return electrode disposed near the earth's surface, the effect being that the viscosity of the liquid hydrocarbons near the producing borehole is reduced, the pressure gradient is redistributed further out in the formation and the enhanced production is net energy effective.

It is another feature of the present invention to enhance the recovery of liquid hydrocarbons from a slowly producing subsurface formation through a borehole extending from the surface of the earth into the formation in an improved manner wherein only a limited portion of the formation is heated by the application of electric power between ring-like electrodes disposed in the formation around the borehole, or between such an electrode and a return electrode disposed near the earth's surface, the effect being that the viscosity of the liquid hydrocarbons near the producing borehole is reduced, the pressure gradient is redistributed further out in the formation and the enhanced production is net energy effective.

It is another feature of the present invention to provide for such enhanced recovery of liquid hydrocarbons from a slowly producing subsurface formation by electrically heating the formation through a ring-like electrode implanted in the formation around the borehole in an improved manner wherein the ring-like electrode is approximated by a plurality of electrode segments.

It is another feature of the present invention to provide for such enhanced recovery of liquid hydrocarbons from a slowly producing subsurface formation by electrically heating the formation through electrodes disposed in the formation around the borehole in an improved manner wherein one of the electrodes is a segment of electrically conductive borehole casing.

It is a feature of the present invention to provide such enhanced recovery in an improved manner through a traditional producing borehole in the formation under the constraint of traditional production well spacing.

SUMMARY OF THE INVENTION

The present invention provides a method and apparatus for electrically heating a slowly producing formation around a borehole to enhance the recovery of hydrocarbon fluids present in the formation under pressure when the existing fluid flow is impeded by the poor mobility or flowability of the hydrocarbonaceous materials in the immediate vicinity of the borehole. The mobility or flowability of those hydrocarbonaceous materials and fluids is increased through decreasing the viscosity of the fluids near the producing borehole. Reduced viscosity of the fluids around the borehole redistributes the formation pressure gradient and permits enchanced flow of fluids from distances in the formation that are over an order of magnitude larger than the distance through which the formation is heated. The present invention achieves these object by optimally electrically heating the formation non-uniformly through electrodes disposed in the formation around the borehole.

Ring-like as used in this application implies either a continuous ring or a set of segments disposed such that the segments produce the equivalent electrical effect as a continuous ring.

A return electrode as used in this application implies an electrode with low impedance relative to a second electrode such that little power is dissipated by the return electrode and the majority of the power is dissipated by the second electrode.

A slowly producing formation as used in this application means a hydrocarbon containing formation with some existing drive mechanization. The liquid hydrocarbons therein have a sufficiently low viscosity that some liquid hydrocarbons are produced without any enhancement. A borehole, as used in this application, means a traditional borehole.

Applying electric power between vertical electrodes disposed in a slowly producing formation which are not configured as an interrelated whole with respect to the particular formation and the borehole is frequently fruitless. The expense of disposing the electrodes and applying the power makes only certain interrelated integrated arrays net energy productive. An interrelated integrated array achieves a synergistic effect of a productive whole relating to the geometry and the geophysics of the formation. Heating with an interrelated electrode array described in this invention is extremely effective in reducing the pressure drop through the entire reservoir, to a distance of 15–20 times the thickness of the hydrocarbon containing formation. Such an effective reduction in pressure drop eliminates a need for extended production drilling holes. Heating with non-coordinated electrodes produces isolated pockets of heat. Heating with a coordinated array of interrelated electrodes has the synergistic effect of favorably redistributing the pressure gradient throughout the formation to distance substantially beyond the electrode array.

Given a dimension and configuration of an interrelated electrode array disposed surrounding, a borehole the geometry and geophysics of the formation, and the level of power applied, estimate the resulting temperature change of the formation with respect to the borehole as a function of distance from the borehole. Given the temperature of the formation as a function, of distance from the borehole and knowing the thermal conductivity of the formation (either a known geological fact or a measured quantity), the temperature of the overburden and underburden, and the thickness of the formation, the energy loss per hour the to overburden and underburden can be predicted. Given the temperature of the formation as a function of distance from the borehole and knowing the initial unheated viscosity of the liquid hydrocarbons, one can predict the changed viscosity of the hydrocarbons contained in the formation around borehole as a function of distance from the borehole using standard correlations found in reservoir engineering books (Amyx, Whiting & Bass, "Petroleum Reservoir Engineering, McGraw-Hill, 1960, p. 442). The productivity in barrels per day from the borehole can be predicted knowing the permeability of the formations (probably a measured quantity), the dimensions of the perforations of the producing portion of the borehole, the natural formation pressure (a geological fact), the bottom hole pressure (controlled by the production facilities at the wellhead), the drainage area of the borehole, the radius of the borehole and the viscosity of the heated liquid hydrocarbons as a function of distance from the borehole. The dimension and configuration of an interrelated electrode array as well as the level of power applied, can be optimized to achieve such temperature of the formation as a function of distance from the borehole that maximizes enchanced production over energy expended and creates a net energy productive system.

Several limiting conditions can be determined in the above process. The power applied to any one electrode is limited by the vaporization temperature of the adjacent fluids. Vaporization of the adjacent fluids greatly reduces an electrode's capacity to heat the adjacent formation. This limit of the power to be applied at any one electrode limits the extent of the heating zone around any one electrode. It has been found that for an optimized energy efficient scheme the mean length of the electrodes must be less than or equal to $1\frac{1}{2}$ times the thickness of the formation. It can also be determined that the mean distance between adjacent electrodes should not be greater than the thickness of the formation and the distance from an electrode to the borehole should not be greater than $1\frac{1}{2}$ times the thickness of the formation.

It has been determined that one optimal configuration for an electrode disposed in the formation is a continuous ring configuration. Moreover, a continuous ring electrode can be approximated for electrical heating purposes by a plurality of electrode segments, arranged in a ring-like formation, where the combined lengths of the electrode segments are at least as long as the circumference of the continuous ring being approximated.

It is also possible to apply electric power between electrodes disposed in the formation and a return electrode disposed close to the surface of the earth, which return electrode has a very low impedance. The return electrode itself may be comprised of a plurality of shallow wells containing metallic material. Electrically conductive casing in the borehole may comprise one electrode disposed in the formation. Production tubing and/or production casing may be used as part of the means to conduct the power from electric sources to the electrodes. Electrodes disposed in the formation should be isolated from electrical contact with the overburden and the underburden. If the formation lies on a significant slant, it may be optimal to dispose the electrodes perpendicular to the formation. The return electrode, if one is used, may be comprised of a continuous ring buried in the ground around the borehole. Salts may be applied around any return electrode disposed near the surface of the earth to reduce its impedance, in particular to reduce its impedance to less than half of that of the electrode disposed in the formation. It may be optimal to apply alternating current, direct current or to alternate between the application of alternating current and direct current in a given formation.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiment thereof which is illustrated in the drawings, which drawings form a part of this specification. It is to be noted, however, that the appended drawings illustrate only a typical embodiment of the invention and are therefore not to be considered limiting of its scope as the invention may admit to other equally effective embodiments.

In the Drawings

FIG. 1 an overhead view of a section taken in the formation illustrating the disposition of an inter-related array of vertical electrodes surrounding a borehole.

FIG. 1A a schematic illustration of one embodiment of the invention.

FIG. 2 is a schematic illustration of a second embodiment of the invention.

FIG. 2A is a sectional view of FIG. 2.

FIGS. 5 and 6 are further schematic illustrations of embodiments of the invention.

DESCRIPTION OF THE PREFERRED EMBODIMENT

Figure 4:
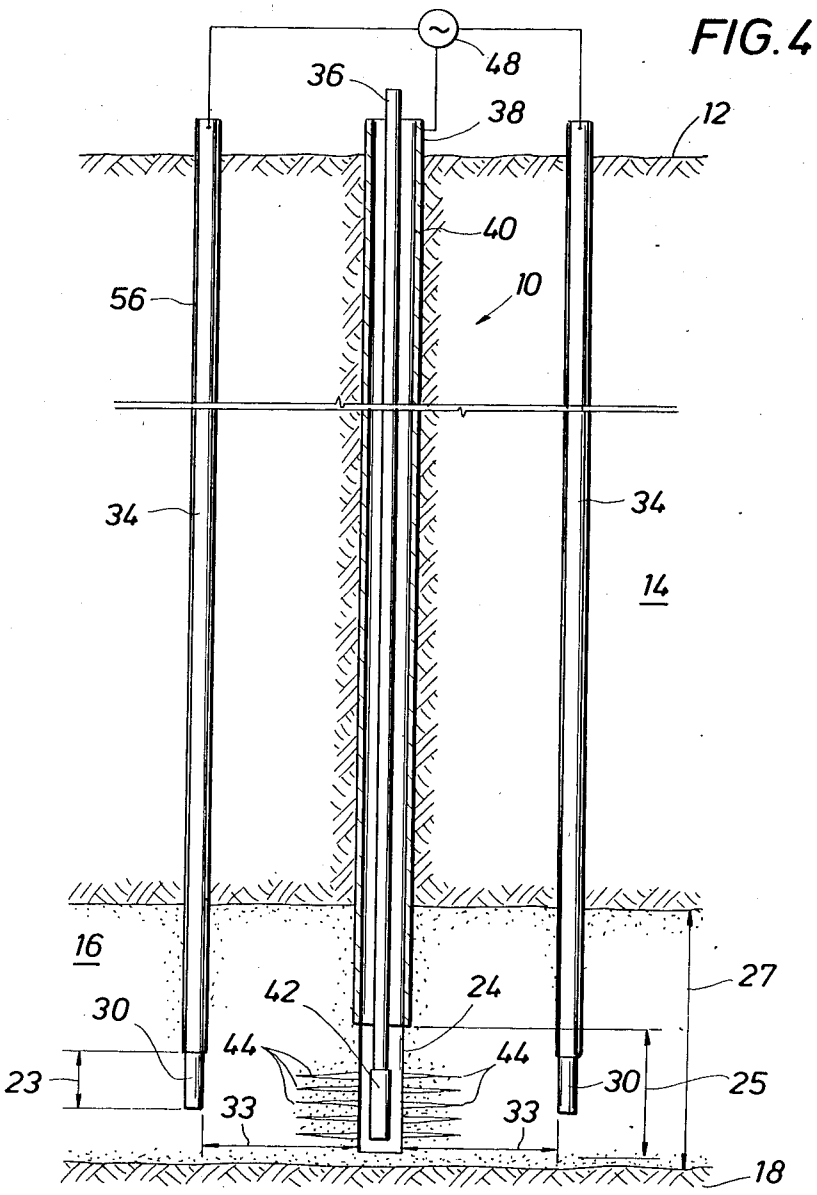
FIG. 4 is a schematic illustration of an embodiment of the invention.

FIG. 1, schematically representing an overhead view of a section taken in the formation, illustrates an interrelated array of vertical electrodes 11 surrounding borehole 10. In FIG. 1 wellbore casing 24 is also utilized as an electrode in conjunction with the interrelated array. The distance of an electrode away from the wellbore, schematically illustrated as 13, is illustrated as not greater than $1\frac{1}{2}$ times formation thickness 27. The distance between adjacent electrodes, schematically illustrated as 21, although not necessarily the same between each electrode, is illustrated as nevertheless less than formation thickness 27. The dimension and configuration of the interrelated arrays of electrode 11 and additional electrode 24, has been optimally determined for the given formation parameters to enhance the production of liquid hydrocarbons from distant portions of the formation through borehole 10 in a net energy effective system.

FIGS. 1A, 2, 2A, 3, 4, 5, and 6 illustrate embodiments of the present invention when the electrodes disposed in the formation are ring-like.

As illustrated in FIGS. 1A, 2, 2A, 3 and 4, it is one aspect of the present invention to create two nearly equipotential ring-like electrodes inside hydrocarbon containing formation 16. In FIGS. 1A, 2, 2A, 3 and 4 borehole 10 extends from surface 12 through overburden 14 and into formation 16, lying above underburden 18.

Figure 3:
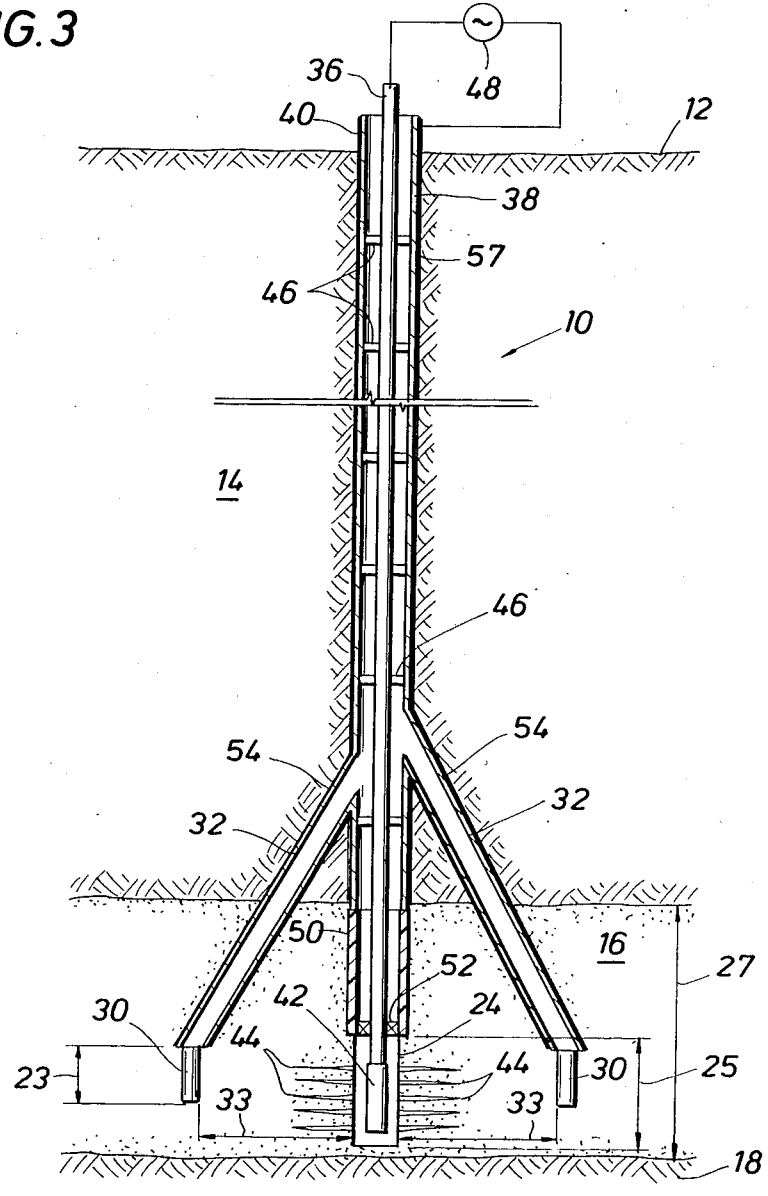
FIG. 3 is a schematic illustration of another embodiment of the invention.

Application of an electric field between two equipotential ring-like electrodes (electrodes 20 and 22 in FIG. 1A, electrodes 24 and 22 in FIGS. 2 and 2A, electrodes 24 and 30 in FIGS. 3 and 4) causes dissipation of the applied electric energy in the region circumscribed by the rings. This results in localized non-uniform heating of the formation circumscribing the borehole, decreasing the viscosity and increasing the flowability of the hydrocarbon fluids. In FIGS. 1A, 2, 2A, 3 and 4, the mean distance from any electrode (variously designated as 15, 17, 19, 29, 33) to the borehole, although not necessarily the same, is illustrated as less than $1\frac{1}{2}$ times formation thickness 27. The mean length of conducting segments of the electrodes, designated 23 and 25 in FIGS. 3 and 4, is illustrated as less than $1\frac{1}{2}$ times formation thickness 27.

FIG. 2 illustrates one aspect of the invention in which the electrically conducting casing of the borehole located within hydrocarbon containing formation 16 is used as one ring-like electrode, electrode 24. FIG. 2A is a sectional view of FIG. 2 illustrating the ring-like aspect of the electrodes in FIG. 2, i.e. electrodes 22 and 24.

FIGS. 3 and 4 illustrate another aspect of the invention in which a ring-like electrode is approximated by disposing electrode segments in the hydrocarbon containing formation 16. In such case, the electrical contact between electrode segments 30 approximating a ring-like electrode are restricted to regions within hydrocarbon containing formation 16 to ensure that the bulk of the energy is dissipated within the formation. The total number of the electrode segments and their length is selected such that their total length is approximately equal to or greater than the circumference of the approximated ring.

Electrode segments 30 comprising a ring-like electrode can be implaced by drilling additional holes from the borehole by whipstock techniques as illustrated in FIG. 3. It is also possible to implace electrode segments 30 by drilling vertically from the surface 12 through overburden 14 into hydrocarbon containing formation 16, as illustrated in FIG. 4. In either case, electrode segments 30 are in electrical contact with hydrocarbon containing formation 16 only and are electrically insulated from other strata. FIG. 3 and FIG. 4 show the use of wrapped insulation 54 and 56 around either adjuncted boreholes 32 drilled by whipstock technique or supplemental vertical boreholes 34 drilled vertically from surface 12. Preferably casing 38 is also wrapped with insulated wrap 57 throughout its entire penetration through overburden 14, but it is exposed to the formation fluids in the formation.

It is one aspect of this invention to electrically connect a ring-like electrode to the power source using production tubing 36. In FIG. 3, conductive packer 52 conducts the current from production tubing 36 to the simulated ring-like electrode 24 in hydrocarbon containing formation 16. In FIG. 3, non-conductive casing 50 isolates electrode casing 24 from the rest of the borehole casing.

As another aspect of the invention, and also illustrated in FIG. 3, conductive casing 38 can be used to connect one ring-like electrode to the power source. In FIG. 3, conductive casing 38 connects power source 48 with electrode segments 30. Conductive casing 38 extends through whipstock boreholes 32. Conductive casing 38 is isolated from contact with the earth through insulating means 46 and 54.

FIGS. 3 and 4 illustrate that liquid hydrocarbons are pumped via pump 42 through perforations 44 in borehole 10.

FIG. 3 also illustrates the use of non-conductive centralizers 46 to keep production tubing 36 electrically isolated from borehole casing 38.

Electric power source 48 may either be a source of alternating current, direct current or both.

FIGS. 5 and 6 illustrate another aspect of the present invention in which electrode 22 is disposed in hydrocarbon containing formation 16 and another electrode is constituted by a return electrode, 26 or 28, disposed at a shallow depth from surface 12 of the earth. The impedance of return electrodes 26 or 28 will be small relative to electrode 22.

In FIG. 5. near surface return electrode 26 could be a continuous ground wire buried in a nearly circular geometry circumscribing borehole 10. As illustrated in FIG. 6, return electrode 28 could also be approximated electrically conductive material such as metal pipes disposed in shallow wells circumscribing borehole 10.

The method described in this invention heats the formation circumscribed by the electrodes disposed in the hydrocarbon containing formation to a temperature whereby the resistance to flow of hydrocarbons toward the borehole becomes negligible. The total distance at which significance heating occurs depends on the location of the electrodes. For the conditions shown in FIGS. 1, 1A, 2, 3 and 4, most of the heating will be confined to the formation between borehole 10 and electrodes. For the conditions shown in FIGS. 5 and 6, the distance to which significant heating occurs will be somewhat (about 30%) larger than the distance between ring-like electrode 22 and borehole 10. It is to be understood in FIGS. 5 and 6 that ring-like electrode 22 can also be approximated by electrode segments 30 as illustrated in FIGS. 3 and 4. Ring-like electrode 22 could also be a generalized integrated electrode array as illustrated in FIG. 1.

The increase in temperature of the formation through dissipation of electric energy must be sufficient to reduce the viscosity of oil by one or two orders of magnitude to adequately reduce the pressure drop. One aspect of the present invention is to optimize the distance between the borehole and the outermost electrode in the formation depending on formation parameters, such as the thickness of the hydrocarbon containing formation and its productivity. It is necessary to relate the distance out of the outermost electrode to formation parameters to prevent electric energy requirements from being excessive.

Use of large distances between the electrodes and the borehole will result in heating larger portions of the formation surrounding the borehole, but the enhancement of the production rate of hydrocarbons does not increase proportionately. Under preferred conditions the distance out of the outermost electrode should be less than $1\frac{1}{2}$ times the thickness of the formation. This is to ensure that vertical heat losses are substantially less than the energy content of the produced oil. It has been found by emperical studies that the radius of an outermost ring-like electrode in feet, under preferred conditions, should be in the range of the number of barrels produced from the formation per day using a six inch diameter borehole without any electric heating. The vertical heat losses under these conditions will be in the order of 10% of the energy content of the produced oil.

What is claimed is:

1. A method for recovering liquid hydrocarbons from a slowly producing subsurface formation through a boreho1e extendng from the surface of the earth into the formation which comprises:

ascertaining the geometry and geophysics of the formation, determining a dimension and configuration of an array of vertical electrodes relative to the geometry and geophysics of the formation to optimize estimated liquid hydrocarbon recovery per unit of electric power applied to the electrodes, disposing in the formation surrounding the borehole such an interrelated array of vertical electrodes distinct from the borehole, applying electric power between the electrodes such that the formation is non-uniformly heated, the viscosity of the liquid hydrocarbons around the borehole is reduced, and the pressure gradient of the liquid hydrocarbons is redistributed in the formation substantially beyond the distance that the formation is heated, and producing liquid hydrocarbons through the borehole.

2. A method for recovering liquid hydroocarbons from a slowly producing subsurface formation through a borehole extending from the surface of the earth into the formation which comprises:

disposing in the formation surrounding the borehole an interrelated array of vertical electrodes distinct from the borehole, the dimensions and configuration of which array have been styled, in conjunction with the level of electric power to be applied, relative to the geometry and geophysics of the formation to optimize recovery for energy expended, disposing a return electrode at a shallow depth from the earth's surface, the return electrode having a relatively low impedance, applying electric power between the electrode array in the formation and the return electrode to non-uniformly heat the formation and reduce the viscosity of the liquid hydrocarbons around the borehole, and producing liquid hydrocarbons through the borehole from portions of the formation substantially beyond the interrelated array.

3. The method in accordance with claims 1 or 2 wherein the borehole contains electrically conductive casing in the hydrocarbon containing formation and which further comprises using such casing as an electrode in conjunction with the interrelated array.

4. The method in accordance with claims 1 or 2 which further comprises limiting the mean distance between two adjacent electrodes in the formation to no more than the thickness of the formation and limiting the mean length of the electrodes to no more than $1\frac{1}{2}$ times the thickness of the formation.

5. A method for recovering liquid hydrocarbons from a slowly producing subsurface formation through a borehole extending from the surface of the earth into the formation which comprises:

disposing two ring-like electrodes around the borehole in the formation, at least one of which has an inside diameter larger than the borehole, to create two nearly equipotential rings, applying electric power between the electrodes at a rate sufficient to increase the temperature of the formation in regions approximately circumscribed by the ring-like electrodes such that the flowability of the liquid hydrocarbons is improved, and producing the liquid. hydrocarbons through the borehole from portions of the formation substantially beyond the ring-like electrodes.

6. A method for recovering liquid hydrocarbons from a slowly producing subsurface formation through a borehole extending from the surface of the earth into the formation which comprises:

disposing one ring-like electrode around the borehole in the formation having a diameter larger than the borehole, disposing a return electrode at a shallow depth from the earth's surface outside the production formation, the return electrode having a relatively low impedance, applying electric power between the electrodes at a rate sufficient to increase the temperature of the formation in regions approximately circumscribed by the ring-like electrode such that the flowability of the liquid hydrocarbons is improved, and producing the liquid hydrocarbons through the borehole from portions of the formation substantially beyond the ring-like electrode.

7. The method in accordance with claims 5 or 6 wherein at least one ring-like electrode is comprised of a plurality of electrode segments electrically approximating a ring, whose segments' combined conductive lengths are at least as long as the circumference of the ring being approximated.

8. The method in accordance with claim 7 wherein the electrode segments comprising a ring-like electrode are disposed with their conductive lengths substantially perpendicular to the formation.

9. The method in accordance with claim 5 wherein the borehole contains electrically conductive casing in the hydrocarbon containing formation and which further comprises using such casing as one of the two ring-like electrodes.

10. The method in accordance with claim 9 which further comprises electrically isolating the electrically conductive casing used as one ring-like electrode from borehole casing in non-hydrocarbon containing strata above or below the hydrocarbon containing formation.

11. The method in accordance with claim 9 wherein the borehole contains electrically conductive production tubing and which further comprises using such tubing to deliver electric power to the borehole casing used as one ring-like electrode.

12. The method in accordance with claim 5 wherein the borehole contains electrically conducting casing and production tubing and which further comprises electrically isolating the casing and the tubing from the earth and from each other, and using the casing and the tubing to deliver power to the two ring-like electrodes.

13. The method in accordance with claims 2 or 6 which further comprises:

forming the return electrode of a continuous ring of wire, and burying the return ring in an approximately circular geometry circumscribing the borehole.

14. The method in accordance with claims 2 or 6 which further comprises forming the return electrode of one or more of shallow wells containing metallic conductors.

15. The method in accordance with claims 2 or 6, which further comprises adding salt to the immediate vicinity of the return electrode to increase the conductivity of the formation and to reduce the impedance of the return electrode.

16. The method in accordance with claim 6 which further comprises adjusting the impedance of the return electrode to be less than half of the impedance of the ring-like electrode disposed in the formation.

17. The method in accordance with claims 5 or 6 which further comprises disposing each electrode in the formation such that the mean distance from the electrode to the borehole is no larger than $1\frac{1}{2}$ times the thickness of the hydrocarbon containing formation.

18. The method in accordance with claims 5 or 6 wherein the electric power is comprised of alternating current.

19. The method in accordance with claims 5 or 6 wherein the electric power is comprised of direct current.

20. The method in accordance with claims 5 or 6 wherein the electric power is comprised at times of direct current and at times of alternating current.

21. An apparatus for recovering liquid hydrocarbons from a slowly producing subsurface formation through a borehole extending from the surface of the earth into the formation which comprises:

two ring-like electrodes disposed in the formation formation surrounding the borehole such that they create two nearly equipotential rings at least one of which has an inside diameter larger than the borehole, a source of electric power, conducting the electric power to means for conducting the electric power to the two ring-like electrodes such that the regions in the formation approximately circumscribed by the two ring-like electrodes are heated to improve the flowability of the liquid hydrocarbon, and means for producing liquid hydrocarbon through the borehole from portions of the formation substantially beyond the ring-like electrodes.

22. An apparatus for recovering liquid. hydrocarbonss from a subsurface formation through a borehole extending from the surface of the earth into the formation which comprises:

one ring-like elecrode disposed in the formation surrounding the borehole having a diameter larger than the borehole, a return electrode disposed at a shallow depth form the earth's surface outside the producing formation, the return electrode having a relatively low impedance, a source of electric power, means for conducting the electric power to the ring-like eIectrode and the return electrode such that the region in the formation approxiamtely circumscribed by the ring-like electrode is heated to improve the flowability of the liquid hydrocarbon, and means for producing liquid hydrocarbon through the borehole from portions of the formation substantially beyond the ring-like electrode.

23. The apparatus in accordance with claims 21 or 22 wherein the means for conducting electric power to a ring-like electrode is insulated so that substantially all of the electric contact is restricted to the hydrocarbon containing formation and little electric contact is made with any non-hydrocarbon statum lying either below or above the formation.

24. The apparatus in accordance with claims 21 or 22 wherein at least one ring-like electrode is comprised of a plurality of electrode segments approximating a ring, whose segments' combined conductive lengths are at least as long as the circumference of the ring being approximated.

25. The apparatus in accordance with claim 24 wherein the electrode segments comprising a ring-like electrode are disposed with their conductive lengths substantially perpendicular to the formation.

26. The apparatus in accordance with claim 21 wherein one of the two ring-like electrodes is comprised of a segment of electrically conductive casing disposed in the borehole, which segment lies in the hydrocarbon containing formation.

27. The apparatus in accordance with claim 26 wherein the segment of conductive casing is electrically isolated from the rest of the casing in the borehole.

28. The apparatus according to claims 21 or 22 wherein the means for conducting electric current is comprised in part of production tubing in the borehole.

29. The apparatus in accordance with claim 21 wherein the means for conducting electric current is comprised in part of conductive casing and production tubing in the borehole.

30. The apparatus in accordance with claim 22 wherein the return electrode is comprised of a continuous ring of wire buried in an approximately circular geometry circumscribing the borehole.

31. The apparatus in accordance with claim 22 wherein the return electrode is comprised of one or more shallow wells containing metallic conductors.

32. The apparatus in accordance with claim 21 wherein the mean distance from a ring-like electrode to the borehole is no larger than $1\frac{1}{2}$ times the thickness of the hydrocarbon containing formation.

33. The apparatus in accordance with claims 21 or 22 wherein the source of electric power is alternating current.

34. The apparatus in accordance with claims 21 or 22 wherein the source of electric power is direct current.

35. The apparatus in accordance with claims 21 or 22 wherein the source of electric power is at times direct current and at times alternating current.

36. The method in accordance with claim 7 wherein the mean distance between two adjacent electrode segments is no greater than the thickness of the formation.

37. The method in accordance with claim 7 wherein the mean length of the electrode segment is no greater than $1\frac{1}{2}$ times the thickness of the formation.

38. The apparatus in accordance with claim 24 wherein the mean distance between two adjacent electrode segments in no greater than the thickness of the formation.

39. The apparatus in accordance with claim 24 wherein the mean length of the electrode segments is no greater than $1\frac{1}{2}$ times the thickness of the formation.

* * * * *